US009130269B2

(12) United States Patent
Tsai et al.

(10) Patent No.: US 9,130,269 B2
(45) Date of Patent: Sep. 8, 2015

(54) WIRELESS COMMUNICATION DEVICE HAVING METAL END PORTION OF HOUSING THEREOF

(71) Applicants: Chih-Yang Tsai, New Taipei (TW); Hao-Ying Chang, New Taipei (TW); Chuan-Chou Chi, New Taipei (TW)

(72) Inventors: Chih-Yang Tsai, New Taipei (TW); Hao-Ying Chang, New Taipei (TW); Chuan-Chou Chi, New Taipei (TW)

(73) Assignee: FIH (HONG KONG) Limited, Kowloon (HK)

( * ) Notice: Subject to any disclaimer, the term of this patent is extended or adjusted under 35 U.S.C. 154(b) by 311 days.

(21) Appl. No.: 13/655,492

(22) Filed: Oct. 19, 2012

(65) Prior Publication Data

US 2013/0154900 A1 Jun. 20, 2013

(30) Foreign Application Priority Data

Dec. 20, 2011 (TW) ..... 100147564

(51) Int. Cl.

| | |
|---|---|
| ***H01Q 1/24*** | (2006.01) |
| ***H01Q 9/42*** | (2006.01) |
| ***H01Q 5/371*** | (2015.01) |

(52) U.S. Cl.
CPC ..... *H01Q 1/243* (2013.01); *H01Q 5/371* (2015.01); *H01Q 9/42* (2013.01)

(58) Field of Classification Search
CPC ..... H01Q 1/243; H01Q 5/371; H01Q 9/42
See application file for complete search history.

(56) References Cited

U.S. PATENT DOCUMENTS

| | | | | |
|---|---|---|---|---|
| 2008/0165067 | A1* | 7/2008 | Kim | 343/702 |
| 2010/0149046 | A1* | 6/2010 | Huang et al. | 343/702 |
| 2010/0188298 | A1* | 7/2010 | Suzuki et al. | 343/702 |
| 2012/0112969 | A1* | 5/2012 | Caballero et al. | 343/702 |

* cited by examiner

*Primary Examiner* — Robert Karacsony
(74) *Attorney, Agent, or Firm* — Novak Druce Connolly Bove + Quigg LLP

(57) ABSTRACT

An exemplary wireless communication device includes a circuit board, a metal end portion, an antenna, and a connecting member. The antenna is positioned on the circuit board. The connecting member interconnects the circuit board and the end portion. The connecting member serves as a feeding point of the antenna. The end portion is a portion of a housing of the wireless communication device and further serves as a radiating portion of the antenna.

20 Claims, 4 Drawing Sheets

WIRELESS COMMUNICATION DEVICE HAVING METAL END PORTION OF HOUSING THEREOF

BACKGROUND

1. Technical Field

The disclosure generally relates to wireless communication devices, and particularly to a wireless communication device with a metal casing.

2. Description of Related Art

Wireless communication devices commonly include metal housings. When a metal housing is employed, it may constitute all or part of a casing of the wireless communication device. This contrasts with conventional plastic casings used for various other wireless communication devices. The metal housing has many advantages, such as high intensity (mechanical strength) and great durability, for example. However, the metal housing may mask and interfere with signals transmitted by an antenna positioned in the wireless communication device, and thus reduce the radiation capability of the antenna.

Therefore the antenna is usually integrated with the metal housing, and uses the metal housing as an antenna radiating body to enhance the radiation capability of the antenna. In one example, a slot antenna such as a GPS (Global Positioning System) antenna or a WIFI (Wireless Fidelity) antenna, for example, is formed in a surface of the metal housing by defining a slot in the surface. When communication signals are fed into the antenna, the metal housing serves as a slot antenna. In another example, a receiving slot is defined in the metal housing. A separate antenna is received in the receiving slot, and is fixed to the metal housing with a plastic member. However, in both the above-described examples, the metal housing may be damaged during the formation of the slot, such that the aesthetic appearance of the metal housing is diminished.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
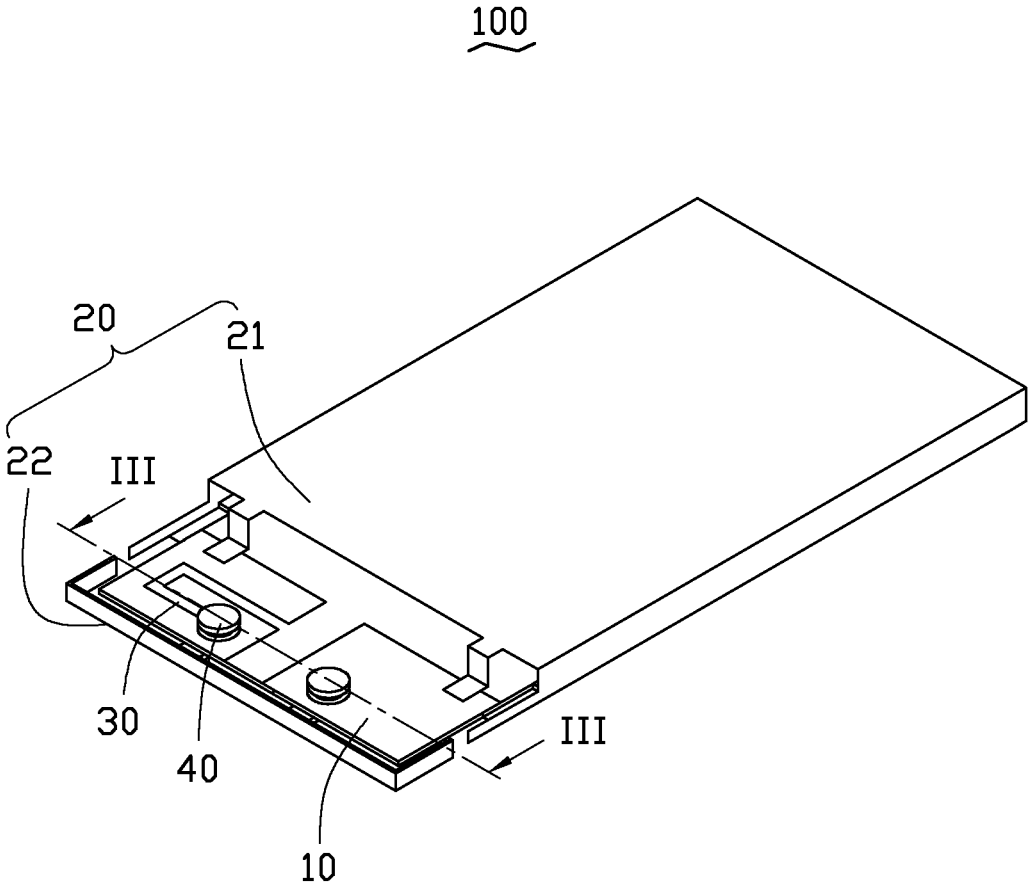
FIG. 1 is a schematic, isometric view of a wireless communication device, according to an exemplary embodiment of the disclosure.

FIG. 1 is a schematic, isometric view of a wireless communication device 100, according to an exemplary embodiment of the disclosure. The wireless communication device 100 includes a circuit board 10, a housing 20, an antenna 30, and at least one connecting member 40. In one exemplary embodiment, there are two connecting members 40. Each connecting member 40 may be a fastener which can engage in a through hole. For example, each connecting member 40 can be a rivet or a screw.

Figure 2:
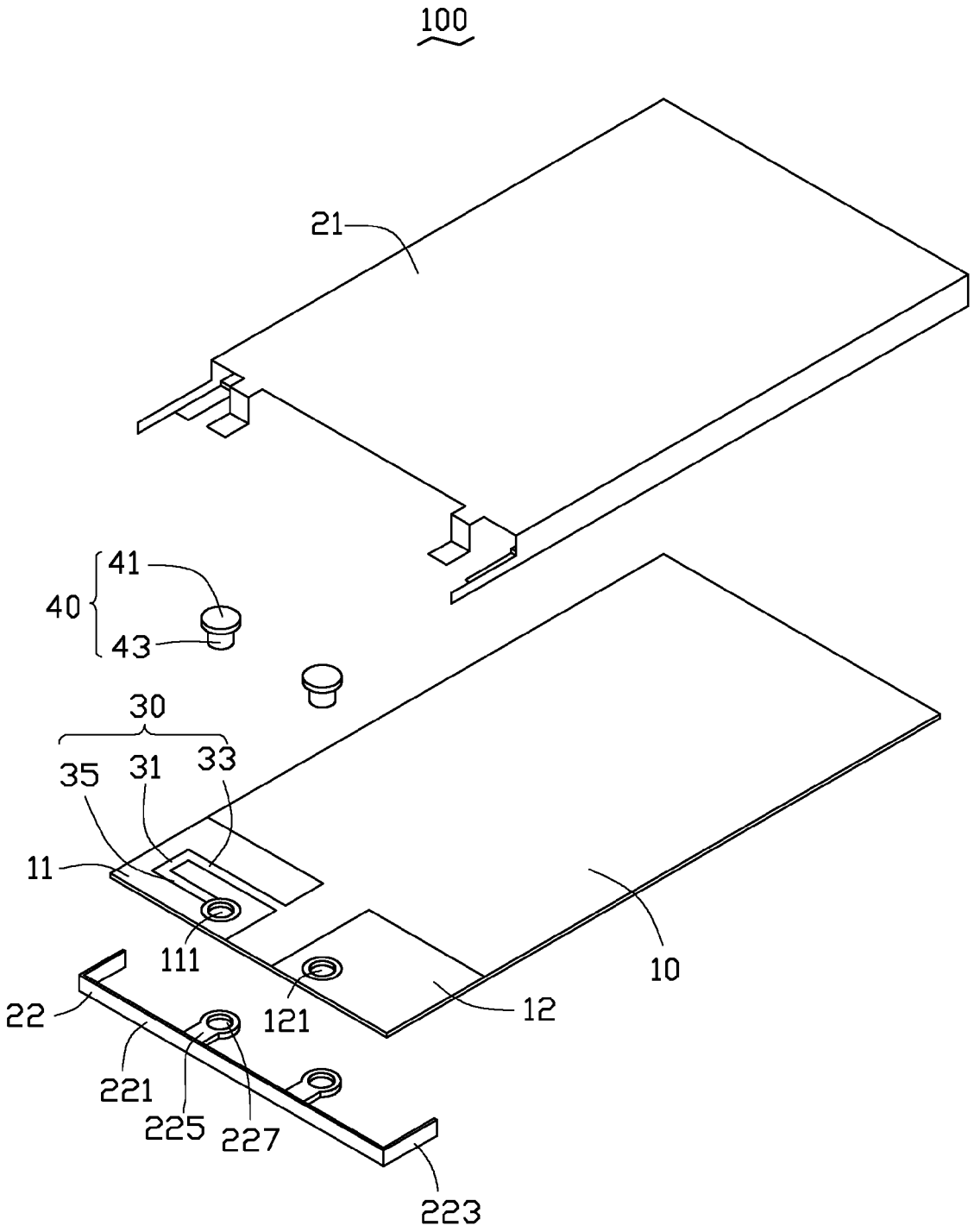
FIG. 2 is an exploded view of the wireless communication device of FIG. 1.

Referring to FIG. 2, the circuit board 10 is substantially a rectangular plate having a metal layer on one major surface thereof. A first mounting area 11 and a second mounting area 12 are formed at two adjacent corners of the circuit board 10. The first mounting area 11 defines a first mounting hole 111. The second mounting area 12 defines a second mounting hole 121. The antenna 30 is formed on the first mounting area 11. The second mounting area 12 is a nonmetallic layer. The circuit board 10 also includes electronic members (not shown), such as a speaker or a camera for example, to support varies functions of the wireless communication device 100.

The housing 20 includes a main body 21 and a metal end portion 22. The main body 21 is a portion of a casing of the wireless communication device 100, and covers the circuit board 10 (see FIG. 1). The main body 21 may be secured to the circuit board 10 by conventional screws.

The end portion 22 includes a first side wall 221, two opposite second side walls 223, and two connecting arms 225. The two second side walls 223 are perpendicularly extended from two ends of the first side wall 221, respectively, and together with the first side wall 221 form the end portion 22 having a generally U shape. The end portion 22 is positioned at an end of the circuit board 10, with the first side wall 221 and the second side walls 223 all parallel with respective edges of the circuit board 10.

Each connecting arm 225 is substantially a strip-shaped sheet. The connecting arms 225 are positioned at one same side of the first side wall 221. In one exemplary embodiment, the connecting arms 225 are positioned at locations evenly trisecting the first side wall 221. Each connecting arm 225 defines a positioning hole 227 with an inner thread thereat, with the positioning holes 227 configured for securing of the end portion 22 to the circuit board 20. When the end portion 22 surrounds the end of the circuit board 10 adjacent to the first mounting area 11 and the second mounting area 12, the positioning holes 227 are aligned with the first mounting hole 111 and the second mounting hole 121, respectively.

The antenna 30 is formed from a metal layer, and is provided in the first mounting area 11. The antenna 30 includes a first radiating section 31, a second radiating section 33, and a third radiating section 35. A remaining portion of the first mounting area 11 is a nonmetallic layer. The first radiating section 31, the second radiating section 33, and the third radiating section 35 are each strip-shaped. A length of the second radiating section 33 is slightly greater than that of the third radiating section 35. The second radiating section 33 and the third radiating section 55 are perpendicularly connected to two ends of the first radiating section 31. One end of the third radiating section 35 opposite to the first radiating section 31 is connected to an electrically conductive ring (or bushing) that surrounds and lines the first mounting hole 111.

Each connecting member 40 is a screw, and includes a head portion 41 and a shank portion 43 with an outer thread. A first one of the connecting members 40 is configured for screwing into the first mounting hole 111 and the corresponding positioning hole 227, and a second one of the connecting members 40 is configured for screwing into the second mounting hole 121 and the corresponding positioning hole 227.

Figure 3:
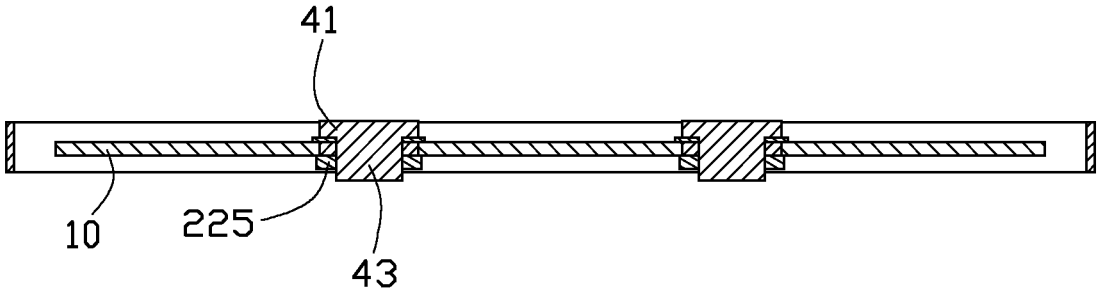
FIG. 3 is a cross-sectional view of the wireless communication device of FIG. 1, taken along a line III-III thereof.

Referring to FIG. 3, when the shank portion 43 of the first connecting member 40 is extended through the first mounting hole 111 and the corresponding positioning hole 227, the end portion 22 is secured to the circuit board 10. That is, in one embodiment, the first connecting member 40 is able to secure the end portion 22 to the circuit board 10 without the assistance of the second connecting member 40.

In addition, the first connecting member 40 serves as a feeding point for the antenna 30, and the end portion 22 serves as a radiating body of the antenna 30. The third radiating section 35, the first radiating section 31 and the second radiating section 33 cooperatively form a first radiating path and obtain a first working frequency band. In one exemplary embodiment, the first working frequency band is about 1922 MHz-2168 MHz. The connecting arm 225 connected to the feeding point (i.e. at the first mounting hole 111), one of the second side walls 223, and a portion of the first side wall 221 positioned between the connecting arm 225 and the second side wall 223 cooperatively form a second radiating path and obtain a second working frequency band. The second working frequency band includes DCS1800 (Digital Cellular System 1800) and PCS1900 (Personal Communications Service 1900). The connecting arm 225 connected to the feeding point (i.e. at the first mounting hole 111), the other one of the second side walls 223, and the remaining portion of the first side wall 221 positioned between the connecting arm 225 and the second side wall 223 cooperatively form a third radiating path and obtain a third working frequency band. In one exemplary embodiment, the third working frequency band includes GSM850 (Global System for Mobile communications 850) and EGSM900 (Extended Global System for Mobile communications 900).

Figure 4:
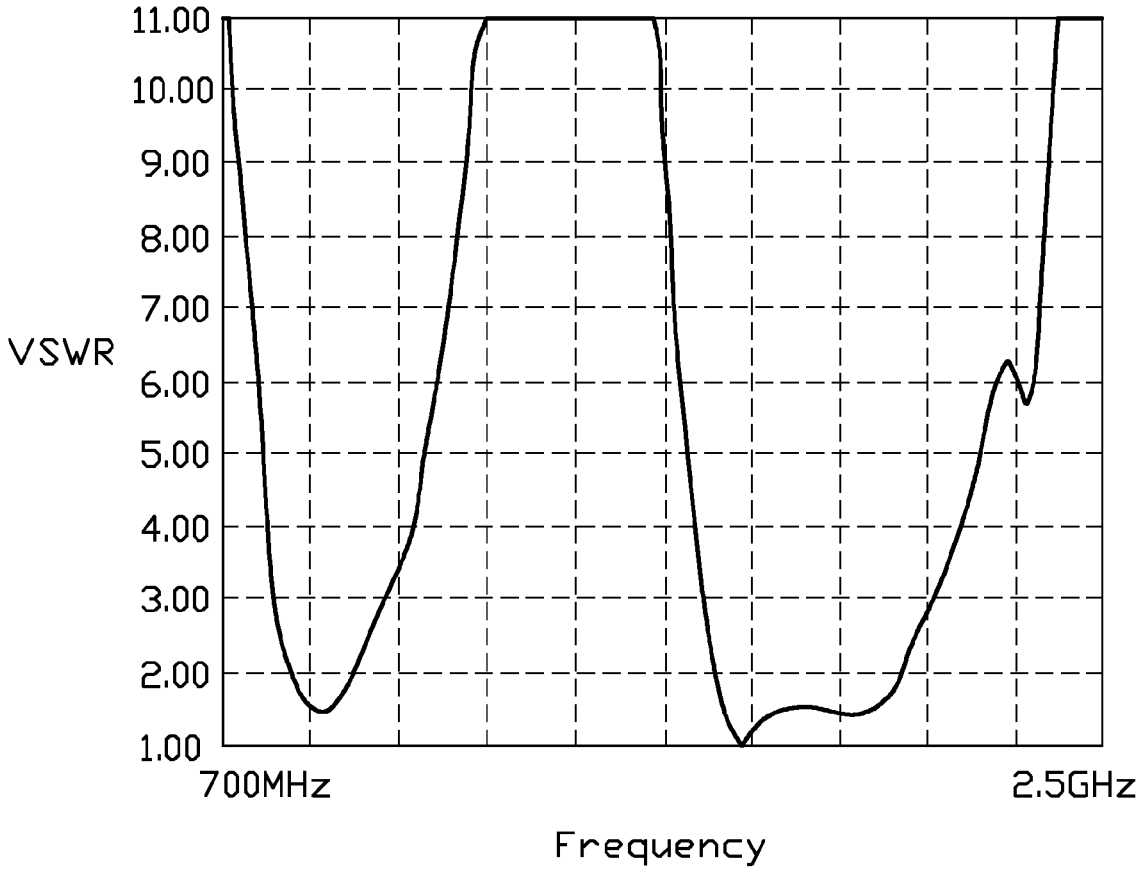
FIG. 4 is a test graph obtained from the wireless communication device of FIG. 1, showing a voltage standing wave ratio (VSWR) varying with frequency, according to an exemplary embodiment of the disclosure.

Referring to FIG. 4 and Table 1, according to test results, the wireless communication device 100 can obtain a better signal radiating effect at multiple working frequency bands.

TABLE 1

| Signal receiving and transmitting efficiency | | | | | |
|---|---|---|---|---|---|
| | Frequency band | | | | First working |
| | GSM850 | EGSM900 | DCS1800 | PCS1900 | frequency band |
| Receiving efficiency | 71.96%-80.88% | 83.54%-83.92 | 78.97%-91.93% | 80.78%-82.81% | 80.44%-85.80% |
| Transmitting efficiency | 82.43%-84.16% | 84.28%-84.76% | 80.78%-82.88% | 80.44%-85.80% | 45.03%-67.24% |

In addition, to ensure that the circuit board 10 is stable relative to the end portion 23, the second connecting member 40 is screwed into and engaged in the second mounting hole 112 and the corresponding positioning hole 227.

In summary, the metal end portion 23 of the wireless communication device 100 is secured to the circuit board 10 by the connecting members 40, with the first connecting member 40 connected to the antenna 30. The end portion 23 serves as a radiating body for the antenna 30 to obtain multiple working frequency bands, whereby the antenna 30 has a better radiating performance. In addition, no slot is defined in the main body 21. Thereby, a pleasant aesthetic appearance of the wireless communication device 100 can be effectively achieved.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments.

What is claimed is:

1. A wireless communication device, comprising:

a circuit board;

a metal end portion, which serves as a portion of a housing of the wireless communication device;

an antenna positioned on the circuit board; and a connecting member interconnecting the circuit board and the end portion; wherein the connecting member extends through the circuit board and through the end portion and serves as a feeding point of the antenna; and the end portion further serves as a radiating body of the antenna.

2. The wireless communication device of claim 1, wherein the antenna comprises a first radiating section, a second radiating section and a third radiating section; the second radiating section and the third radiating section are perpendicularly connected to two ends of the first radiating section; the connecting member is positioned at an end of the third radiating section opposite to the first radiating section; and the first radiating section, the second radiating section, and the third radiating section together form a first radiating path.

3. The wireless communication device of claim 2, wherein the end portion comprises a first side wall, two opposite second side walls, and a connecting arm; the two second side walls are perpendicularly extended from two ends of the first side wall, respectively, and the connecting arm is extended from one side of the first side wall; the connecting arm, one of the second side walls, and a portion of the first side wall therebetween together form a second radiating path; and the connecting arm, the other one of the second side walls, and the remaining portion of the first side wall together form a third radiating path.

4. The wireless communication device of claim 3, wherein the connecting arm is positioned approximately one-third of the way along a length of the first side wall.

5. The wireless communication device of claim 3, wherein the end portion surrounds an end of the circuit board; and the first side wall and the second side walls are parallel with corresponding edges of the circuit board.

6. The wireless communication device of claim 3, wherein the circuit board defines a mounting hole, the connecting arm defines a positioning hole corresponding to the mounting hole, and the connecting member is engaged in the mounting hole and the positioning hole.

7. The wireless communication device of claim 6, wherein the connecting member is a screw screwed into the mounting hole and the corresponding positioning hole.

8. The wireless communication device of claim 2, wherein the circuit board comprises a first mounting area defined at a corner thereof, the antenna is formed from a metal layer of the first mounting area, and the remaining portion of the first mounting area is a nonmetallic layer.

9. The wireless communication device of claim 8, further comprising another connecting member, wherein the circuit board further comprises a second mounting area defined at another corner thereof adjacent to the first mounting area, the connecting member interconnects the circuit board and the end portion at the first mounting area, and the another connecting member interconnects the circuit board and the end portion at the second mounting area.

10. A wireless communication device, comprising:

a circuit board;

a metal end portion, which serves as a portion of a housing of the wireless communication device;

an antenna positioned on the circuit board, the antenna comprising a first radiating section, a second radiating section and a third radiating section; the second radiating section and the third radiating section perpendicularly connected to two ends of the first radiating section; and a connecting member interconnecting the circuit board and the end portion; wherein the connecting member serves as a feeding point of the antenna; and the end portion further serves as a radiating body of the antenna.

11. The wireless communication device of claim 10, wherein the connecting member extends through the circuit board and through the end portion.

12. The wireless communication device of claim 10, wherein the connecting member is positioned at an end of the third radiating section opposite to the first radiating section; and the first radiating section, the second radiating section, and the third radiating section together form a first radiating path.

13. The wireless communication device of claim 12, wherein the end portion comprises a first side wall, two opposite second side walls, and a connecting arm; the two second side walls are perpendicularly extended from two ends of the first side wall, respectively, and the connecting arm is extended from one side of the first side wall; the connecting arm, one of the second side walls, and a portion of the first side wall therebetween together form a second radiating path; and the connecting arm, the other one of the second side walls, and the remaining portion of the first side wall together form a third radiating path.

14. The wireless communication device of claim 13, wherein the connecting arm is positioned approximately one-third of the way along a length of the first side wall.

15. The wireless communication device of claim 13, wherein the end portion surrounds an end of the circuit board; and the first side wall and the second side walls are parallel with corresponding edges of the circuit board.

16. The wireless communication device of claim 13, wherein the circuit board defines a mounting hole, the connecting arm defines a positioning hole corresponding to the mounting hole, and the connecting member is engaged in the mounting hole and the positioning hole.

17. A wireless communication device, comprising:

a circuit board;

a metal end portion, which serves as a portion of a housing of the wireless communication device, the end portion comprising a first side wall, two opposite second side walls, and a connecting arm; the two second side walls perpendicularly extended from two ends of the first side wall, respectively, and the connecting arm extended from one side of the first side wall;

an antenna positioned on the circuit board; and a connecting member interconnecting the circuit board and the end portion; wherein the connecting member serves as a feeding point of the antenna; and the end portion further serves as a radiating body of the antenna.

18. The wireless communication device of claim 17, wherein the end portion surrounds an end of the circuit board; and the first side wall and the second side walls are parallel with corresponding edges of the circuit board.

19. The wireless communication device of claim 17, wherein the antenna comprises a first radiating section, a second radiating section and a third radiating section; the second radiating section and the third radiating section are perpendicularly connected to two ends of the first radiating section; the connecting member is positioned at an end of the third radiating section opposite to the first radiating section; and the first radiating section, the second radiating section, and the third radiating section together form a first radiating path.

20. The wireless communication device of claim 19, wherein the connecting arm, one of the second side walls, and a portion of the first side wall therebetween together form a second radiating path; and the connecting arm, the other one of the second side walls, and the remaining portion of the first side wall together form a third radiating path.

* * * * *